US008935157B2

(12) United States Patent
Kim et al.

(10) Patent No.: US 8,935,157 B2
(45) Date of Patent: Jan. 13, 2015

(54) AUDIO DECODING SYSTEM AND AN AUDIO DECODING METHOD THEREOF FOR COMPRESSING AND STORING DECODED AUDIO DATA IN A FIRST TIME INTERVAL AND DECOMPRESSING THE STORED AUDIO DATA IN A SECOND TIME INTERVAL

(75) Inventors: Byoungil Kim, Hwaseong-si (KR); Jongin Kim, Hwasung-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 967 days.

(21) Appl. No.: 13/053,336

(22) Filed: Mar. 22, 2011

(65) Prior Publication Data

US 2011/0246206 A1 Oct. 6, 2011

(30) Foreign Application Priority Data

Apr. 5, 2010 (KR) ..... 10-2010-0031066

(51) Int. Cl.

| | |
|---|---|
| ***G10L 21/00*** | (2013.01) |
| ***G10L 25/00*** | (2013.01) |
| ***G10L 19/00*** | (2013.01) |
| ***G10L 19/16*** | (2013.01) |

(52) U.S. Cl.

CPC ..... *G10L 19/167* (2013.01)

USPC ..... 704/211; 704/201; 704/200

(58) Field of Classification Search

USPC ..... 704/500, 501, 503, 200–232

See application file for complete search history.

(56) References Cited

U.S. PATENT DOCUMENTS

| | | | | |
|---|---|---|---|---|
| 6,169,973 | B1 | 1/2001 | Tsutsui et al. | |
| 6,332,175 | B1 * | 12/2001 | Birrell et al. | 711/112 |
| 6,356,595 | B1 * | 3/2002 | Czaja et al. | 375/262 |
| 2002/0103977 | A1 * | 8/2002 | Ewoldt | 711/140 |
| 2003/0060911 | A1 * | 3/2003 | Chan et al. | 700/94 |
| 2005/0200505 | A1 | 9/2005 | Rao et al. | |
| 2007/0217617 | A1 | 9/2007 | Kakara | |
| 2007/0286288 | A1 * | 12/2007 | Smith et al. | 375/240.24 |
| 2009/0070119 | A1 * | 3/2009 | Yoo et al. | 704/500 |

FOREIGN PATENT DOCUMENTS

KR 1020070102225 10/2007

* cited by examiner

*Primary Examiner* — Jesse Pullias

(74) *Attorney, Agent, or Firm* — F. Chau & Associates, LLC

(57) ABSTRACT

An audio decoding system including a decoder decoding a first part of audio data, and an audio buffer compressor compressing and storing the decoded first part of audio data in a first time interval and decompressing the stored first part of audio data in a second time interval.

18 Claims, 8 Drawing Sheets

AUDIO DECODING SYSTEM AND AN AUDIO DECODING METHOD THEREOF FOR COMPRESSING AND STORING DECODED AUDIO DATA IN A FIRST TIME INTERVAL AND DECOMPRESSING THE STORED AUDIO DATA IN A SECOND TIME INTERVAL

CROSS-REFERENCE TO RELATED APPLICATION

This U.S. non-provisional patent application claims priority under 35 U.S.C. §119 to Korean Patent Application No. 10-2010-0031066, filed on Apr. 5, 2010, the disclosure of which is incorporated by reference herein in its entirety.

BACKGROUND

1. Technical Field

The present inventive concept relates to an audio decoding system and an audio decoding method thereof.

2. Discussion of the Related Art

If an audio stream is not played seamlessly, a user's listening experience may be diminished. To prevent the interruption of an audio stream, an audio decoding system may include an output buffer for buffering the audio stream. However, such an output buffer may be large in size.

SUMMARY

The present inventive concept provides an audio decoding system for reducing a size of an output buffer and an audio decoding method thereof.

The present inventive concept also provides an audio decoding system for reducing power consumption and an audio decoding method thereof.

An exemplary embodiment of the inventive concept provides an audio decoding system including: a first decoder decoding a first part of audio data; and an audio buffer compressor compressing and storing the decoded first part of audio data in a first time interval and decompressing the stored first part of audio data in a second time interval.

In an exemplary embodiment, the audio decoding system may further include: at least one information provider (IP) storing the first part of audio data prior to the decoding of the first part of audio data; and a memory storing the first part of audio data delivered from the at least one IP prior to the decoding of the first part of audio data.

In an exemplary embodiment, the audio decoding system may further include a direct memory access (DMA) allowing the first part of audio data to be delivered directly from the at least one IP to the memory.

In an exemplary embodiment, the first decoder may be a processor; the processor may be in an active mode, in the first time interval, when the first part of audio data is decoded; and the processor may be in a sleep mode, in the first time interval, after the decoded first part of audio data is compressed.

In an exemplary embodiment, the audio buffer compressor may include: a first encoder compressing the decoded first part of audio data in the first time interval and compressing a decoded second part of audio data in the second time interval; a first output buffer storing the compressed first part of audio data; a second output buffer storing the compressed second part of audio data; and a second decoder decompressing, in the second time interval, the compressed first part of audio data stored in the first output buffer, and decompressing, in a third time interval after the second time interval, the compressed second part of audio data stored in the second output buffer.

In an exemplary embodiment, the first encoder may include: a mid-side coder removing spatial redundancy from each of the first and second parts of audio data using mid-side coding when the first and second parts of audio data are stereo audio data; a finite impulse response filter selectively removing frequency region redundancy from an output of the mid-side coder; and an entropy coder compressing statistical data from an output of the finite impulse response filter using Golomb-Rice coding.

In an exemplary embodiment, the second decoder may include: an entropy decoder performing an inverse function of the entropy coder by decoding the compressed first part of audio data stored in the first output buffer or the compressed second part of audio data stored in the second output buffer using the Golomb-Rice coding; an infinite impulse response filter restoring the removed frequency region redundancy by performing an inverse function of the finite impulse response filter; and a mid-side decoder restoring the removed spatial redundancy by performing an inverse function of the mid-side coder.

In an exemplary embodiment, the audio decoding system may further include a processor separate from the first decoder.

In an exemplary embodiment, the audio buffer compressor may decompress another part of audio data in the first time interval, the another part of audio data having been decoded by the first decoder and compressed and stored by the audio buffer compressor prior to the first time interval In an exemplary embodiment of the inventive concept, an audio decoding system may include: a plurality of IPs, at least one of the IPs storing audio data; a memory storing the audio data delivered from the at least one of the plurality of IPs; a DMA allowing the plurality of IPs to directly access the memory; a processor performing a decoding operation on the audio data; an audio buffer compressor compressing and storing the decoded audio data in a first time interval and decompressing and outputting the stored audio data in a second time interval; a digital-to-analog converter (DAC) converting the audio data output from the audio buffer compressor into an analog signal in the second time interval; and a speaker outputting the converted analog signal to the outside of the audio decoding system in the second time interval.

In an exemplary embodiment, the processor may decode a first part of the audio data in the first time interval and be in a sleep mode in the first time interval after the decoding of the first part of the audio data is completed, and the processor may decode a second part of the audio data in the second time interval and be in the sleep mode in the second time interval after the decoding of the second part of the audio data is completed.

In an exemplary embodiment, the audio buffer compressor may include an output buffer storing the compressed audio data.

In an exemplary embodiment, the speaker may output a converted analog signal to the outside of the audio decoding system in the first time interval, wherein this converted analog signal corresponds to a part of the audio data that is decompressed by and output from the audio buffer compressor in the first time interval.

In an exemplary embodiment of the inventive concept, an audio decoding system may include: a plurality of IPs, at least one of the IPs storing audio data; a memory storing the audio data delivered from the at least one of the plurality of IPs; a DMA allowing the plurality of IPs to directly access the memory; a processor controlling operations of the audio decoding system; an audio subsystem decoding a first frame of the audio data received from the memory, compressing the decoded first frame of audio data in a first time interval, and outputting the compressed first frame of audio data in a second time interval; a DAC converting an output of the audio subsystem into an analog signal; and a speaker outputting the converted analog signal to the outside of the audio decoding system in the second time interval.

In an exemplary embodiment, the audio subsystem may include: an input buffer receiving the first frame of audio data from the memory; a main audio decoder decoding the first frame of audio data received by the input buffer; and an audio buffer compressor compressing and storing an output of the main audio decoder in the first time interval, the output of the main audio decoder including the decoded first frame of audio data, and decompressing the compressed first frame of audio data in the second time interval.

In an exemplary embodiment, the audio buffer compressor may include: a first output buffer storing the first frame of audio data compressed in the first time interval; and a second output buffer storing the compressed first frame of audio data that are to be decompressed in the second time interval.

In an exemplary embodiment, the input buffer and the first and second output buffers may be included in one buffer memory; and the buffer memory may allocate regions of the buffer memory to the input buffer and the first and second output buffers.

In an exemplary embodiment of the inventive concept, an audio decoding method includes: in a first time interval, decoding an N (N is a natural number) frame of audio data in a processor or an audio decoder, compressing the decoded N frame of audio data in an audio buffer compressor, and decompressing a compressed N−1 frame of audio data in the audio buffer compressor; and in a second time interval, decoding an N+1 frame of audio data in the processor or audio decoder, compressing the decoded N+1 frame of audio data in the audio buffer compressor, and decompressing the compressed N frame of audio data in the audio buffer compressor.

In an exemplary embodiment, the audio decoding method may further include, in the first time interval, converting the decompressed N−1 frame of audio data into an analog signal in a DAC and outputting, from a speaker, the analog signal of the converted N−1 frame of audio data to the outside of the speaker.

In an exemplary embodiment, the audio decoding method may further comprise, in the second time interval, converting the decompressed N frame of audio data into an analog signal in the DAC and outputting, from the speaker, the analog signal of the converted N frame of audio data to the outside of the speaker.

In an exemplary embodiment, the N frame of audio data compressed in the first time interval may be stored in a first output buffer; and the N+1 frame of audio data compressed in the second time interval may be stored in a second output buffer.

In an exemplary embodiment of the inventive concept, an audio decoding system includes: a decoder decoding a first frame of audio data in a first time interval; an audio buffer compressor compressing the first frame of audio data in the first time interval after the first frame of audio data is decoded, decompressing a second frame of audio data in the first time interval, the second frame of audio data corresponding to audio data decoded by the decoder and compressed by the audio buffer compressor prior to the first time interval, wherein the second frame of audio data is decompressed simultaneously to the decoding of the first frame of audio data and the compressing of the first frame of audio data; and a speaker outputting, to the outside of the audio decoding system, sound corresponding to the decompressed second frame of audio data simultaneously to the decompressing of the second frame of audio data in the first time interval.

BRIEF DESCRIPTION OF THE DRAWINGS

The above and other features of the inventive concept will become more apparent by describing in detail exemplary embodiments thereof with reference to the accompanying drawings. In the drawings.

DETAILED DESCRIPTION OF THE EMBODIMENTS

Exemplary embodiments of the inventive concept will be described below in more detail with reference to the accompanying drawings. The inventive concept may, however, be embodied in different forms and should not be construed as limited to the embodiments set forth herein.

Figure 1:
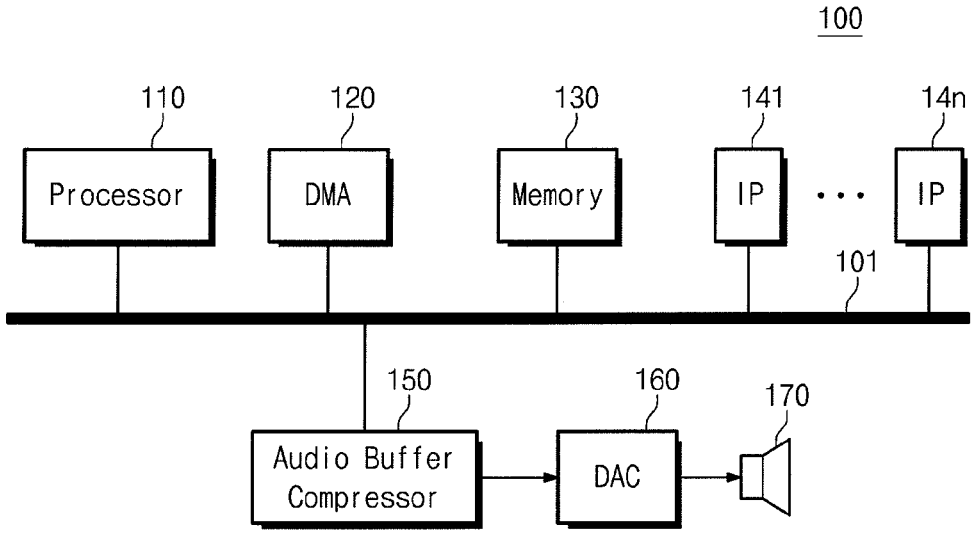
FIG. 1 is a block diagram illustrating an audio decoding system according to an exemplary embodiment of the inventive concept.

FIG. 1 is a block diagram illustrating an audio decoding system 100 according to an exemplary embodiment of the inventive concept. Referring to FIG. 1, the audio decoding system 100 includes a processor 110, a direct memory access (DMA) 120, a memory 130, a plurality of information providers (IPs) 141 to **14*n*, an audio buffer compressor 150, a digital-to-analog converter (DAC) 160, and a speaker 170. The processor 110, the DMA 120, the memory 130, the plurality of IPs 141 to 14*n*, and the audio buffer compressor 150 are connected through a bus 101**.

The audio decoding system 100 may be an MPEG-1 audio layer 3 (MP3) player or an advanced audio coding (AAC) player.

The processor 110 controls general operations of the audio decoding system 100. The processor 110 decodes audio data outputted from at least one of the plurality of IPs 141 to **14*n*. Here, the audio data outputted from at least one of the plurality of IPs 141 to 14*n* are temporarily stored in the memory 130** and are compressed by voice coding such as MP3 or AAC. What the processor 110 decodes audio data may mean is that voice data compressed by the voice coding are decoded by the processor 110. According to an exemplary embodiment, the processor 110 may be a mobile processor.

The DMA 120 may perform a function by which at least one of the plurality of IPs 141 to 14*n* directly accesses the memory 130. For example, audio data outputted from at least one among the plurality of IPs 141 to 14*n* are directly delivered to the memory 130 by the DMA 120, without passing through the processor 110.

The memory 130 temporarily stores data necessary for performing an operation of the processor 110 or the audio data. For example, the memory 130 temporarily stores audio data for decoding. Here, the audio data are delivered from at least one storage device among the plurality of IPs 141 to 14*n*.

The plurality of IPs 141 to 14*n* are devices for performing specific functions. At least one of the plurality of IPs 141 to 14*n* may be a storage device for storing audio data.

The audio buffer compressor 150 receives audio data by a frame unit, which are decoded by the processor 110, and a compact encoder of the audio buffer compressor 150 compresses the received audio data. An output buffer of the audio buffer compressor 150 stores the compressed audio data, and a compact decoder of the audio buffer compressor 150 decompresses the audio data stored in the output buffer and outputs the decompressed audio data by a frame unit. Here, the compact encoder and the compact decoder mutually perform an inverse function. Although not illustrated here, the audio buffer compressor 150 may further include an interface for outputting the decompressed audio data.

The DAC 160 converts the audio data outputted from the audio buffer compressor 150 into an analog signal.

The speaker 170 outputs the analog signal converted by the DAC 160 to the outside. The speaker 170 may include a left channel speaker and a right channel speaker, both of which are not shown in the drawings.

In summary, the audio decoding system 100 decodes audio data by a frame unit, compresses the decoded audio data, stores the compressed audio data in the audio buffer compressor 150, and then decompresses the stored audio data to be output.

The audio decoding system 100 according to an exemplary embodiment of the inventive concept may reduce a size of an output buffer compared to that of a conventional audio decoding system, by equipping itself with the audio buffer compressor 150 for compressing the decoded audio data and storing the compressed audio data. As a result, the integration level of the audio decoding system 100 may increase.

To reduce power consumption during an audio decoding operation, the sleep mode time of a processor and devices related thereto (for example, a plurality of IPs) may be increased.

A conventional audio decoding system may not be able to sufficiently increase the sleep mode time of a processor due to an amount of space available in its audio buffer. On the contrary, the audio buffer compressor 150 according to an exemplary embodiment of the inventive concept may store a relatively high amount of decoded audio data compared to a conventional output buffer, by storing the compressed audio data in the compressor 150. Accordingly, the audio decoding system 100 may lengthen a cycle for decoding audio data (or, an activity mode of a processor) compared to that of a conventional audio decoding system by increasing the sleep mode time of the processor 110. As a result, the audio decoding system 100 may have less power consumption compared to a conventional audio decoding system.

Moreover, the audio decoding system 100 may obtain a sufficient wake up duration as the sleep mode time of the processor 110 is increased. Accordingly, the processor 110 may have to perform fewer preliminary operations, which are necessary for waking up from a sleep mode. In other words, additional operations necessary for mode switching are reduced by decreasing the number of mode switching operations in the processor 110.

Figure 2:
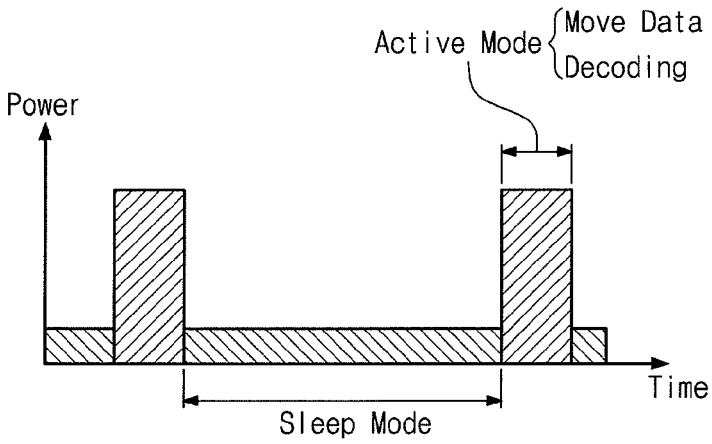
FIG. 2 is a view illustrating power consumption of the audio decoding system of FIG. 1 according to an operation mode of a processor therein.

FIG. 2 is a view illustrating power consumption of the audio decoding system 100 according to an operation mode of the processor 110 shown in FIG. 1. Referring to FIG. 2, when the processor 110 is in an active mode (for example, during data transmission or audio data decoding), power consumption is high. On the contrary, when the processor 110 is in a sleep mode, less power is consumed. Accordingly, to reduce power consumption during audio decoding, tone can increase the sleep mode time of the processor 110.

The audio decoding system 100 reduces power consumption by lengthening a cycle in which the processor 110 delivers the decoded audio data from the memory 130 to the audio buffer compressor 150. To lengthen this cycle, compression of the decoded audio data and decompression of previously decoded audio data are performed by the audio buffer compressor 150 while the processor 110 delivers the decoded audio data and while the processor 110 is in a sleep mode.

The audio decoding system 100 may be applied to mobile applications since it can maintain a low power operation mode (e.g., a sleep mode) of the processor 110 for a long time during audio decoding.

Figure 3:
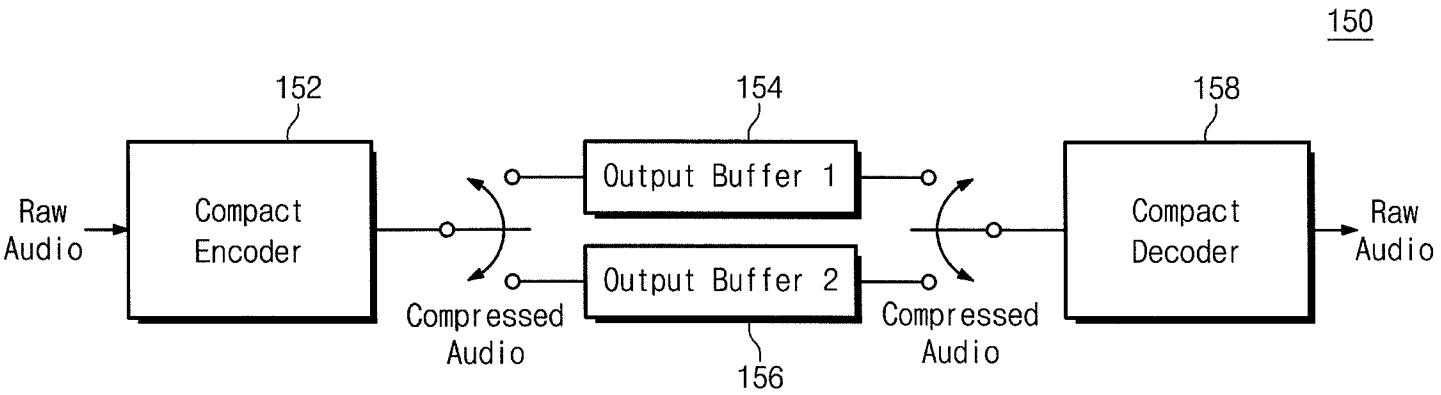
FIG. 3 is a block diagram illustrating an audio buffer compressor according to an exemplary embodiment of the inventive concept.

FIG. 3 is a block diagram illustrating the audio buffer compressor 150 according to an exemplary embodiment of the inventive concept. Referring to FIG. 3, the audio buffer compressor 150 includes a compact encoder 152, a first output buffer 154, a second output buffer 156, and a compact decoder 158.

The compact encoder 152 compresses audio data (e.g., raw audio data), which are decoded by the processor 110. Here, the audio data are compressed by a frame unit. The audio data compressed by a frame unit are outputted through one of the first output buffer 154 and the second output buffer 156. The compact encoder 152 outputs the compressed audio data to the first output buffer 154 and the second output buffer 156 alternately.

The first output buffer 154 and the second output buffer 156 sequentially store the compressed audio data. For example, the compressed audio data of an N−1 frame are stored in the second output buffer 156, the compressed audio data of an N frame are stored in the first output buffer 154, and the compressed audio data of an N+1 frame are stored in the second output buffer 156.

The compact decoder 158 decompresses the compressed audio data stored in one of the first output buffer 154 and the second output buffer 156. The compact decoder 158 alternately decompresses the compressed audio data stored in the first output buffer 154 or the second output buffer 156. In other words, the compact decoder 158 decompresses the compressed audio data stored in the first output buffer 154 and then decompresses the compressed audio data stored in the second output buffer 156. The compact decoder 158 decompresses (or decodes) the compressed audio data stored in the first output buffer 154 and the second output buffer 156 in real time and then delivers the raw audio data to the DAC 160.

The audio decoding system 100 drives high quality audio coders such as an MP3 coder by a frame unit of more than about 1000 samples, for example. At this point, the processor 110 terminates an operation within an audio sample playing time in a frame interval. The compact encoder 152 is realized with a structure to complete an operation at a sleep mode interval of the processor 110 (or, a main decoder). The compact decoder 158 is realized with a structure to perform a real time and continuous processing operation to deliver an audio sample to the DAC 160 with an audio sampling frequency.

Figure 4:
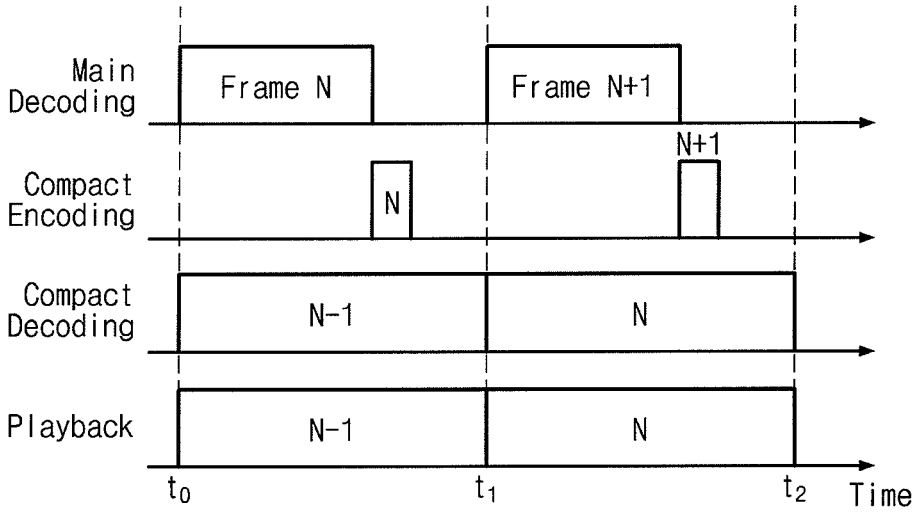
FIG. 4 is a view illustrating an operating time of an audio decoding system according to an exemplary embodiment of the inventive concept.

FIG. 4 is a view illustrating an operating time of the audio decoding system 100 according to an exemplary embodiment of the inventive concept. Referring to FIG. 4, the operating time of the audio decoding system 100 is as follows.

At a first interval t0 to t1, main decoding of the processor 110 for an N frame is performed and compact encoding (or, compression) of the compact encoder 152 is performed after the main decoding. Simultaneously, compact decoding of the compact decoder 158 for an N−1 frame is performed and, while the compact decoded (or, decompressed) N−1 frame is converted into an analog signal in real time, the converted analog signal is played through the speaker 170.

At a second interval t1 to t2, main decoding of the processor 110 for an N+1 frame is performed and compact encoding (or, compression) of the compact encoder 152 is performed on the N+1 frame after the main decoding. Simultaneously, compact decoding of the compact decoder 158 for the N frame is performed and, while the compact decoded (or, decompressed) N frame is converted into an analog signal in real time, the converted analog signal is played through the speaker 170.

Additionally, the first interval t0 to t1 and the second interval t1~t2 are the same amount of time.

Moreover, the processor 110 is in an active mode at main decoding intervals of the first interval t0~t1 and the second interval t1~t2. However, the processor 110 may enter a sleep mode from a main decoding completion time point of the first interval t0~t1 to the main decoding starting time point of the second interval t1~t2.

An audio decoding method of the audio decoding system 100 according to an exemplary embodiment of the inventive concept may sequentially perform decoding and compact encoding on an N frame and simultaneously perform compact decoding and playing on an N−1 frame. Thereby, the audio decoding method may play audio data in real time.

Figure 5:
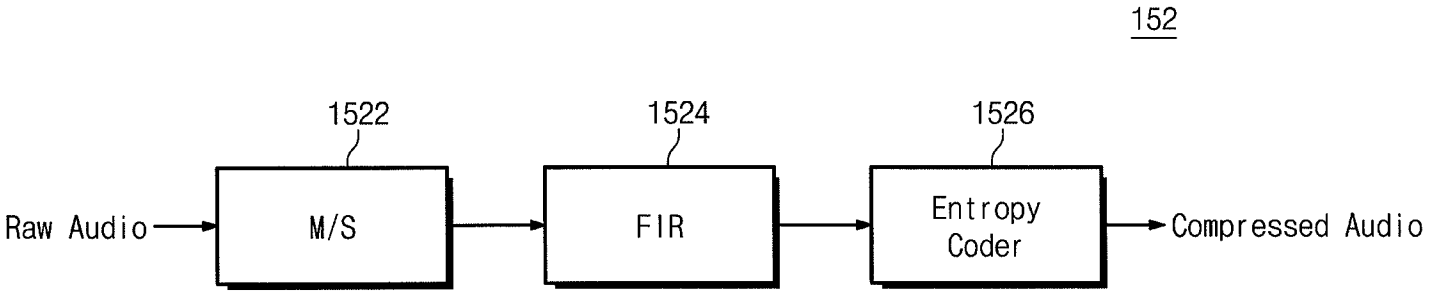
FIG. 5 is a block diagram illustrating an compact encoder according to an exemplary embodiment of the inventive concept.

FIG. 5 is a block diagram illustrating the compact encoder 152 according to an exemplary embodiment of the inventive concept. Referring to FIG. 5, the compact encoder 152 includes a mid-side coder (or, M/S) 1522, a finite impulse response filter (or, FIR) 1524, and an entropy coder 1526.

The mid-side coder 1522 removes spatial redundancy from raw audio data using mid-side coding when audio data are stereo audio data. The mid-side coder 1522 removes a correlation component between audio samples through mid-side coding. Here, the mid-side coding converts a left channel and a right channel into a side channel. Here, a mid channel is the sum of the left channel and the right channel, and the side channel is a difference between the left channel and the right channel.

The compact encoder 152 may not necessarily use the mid-side coding to remove the spatial redundancy. The compact encoder 152 may use various kinds of joint stereo coding to remove the spatial redundancy.

The finite impulse response filter 1524 is a linear filter and is used to selectively remove frequency region redundancy. The frequency region redundancy may include low band frequency components. In other words, the finite impulse response filter 1524 decreases an amount of information by reducing low frequency components that require a significant amount of energy.

In general, the finite impulse response filter 1524 is a digital filter through which output data include a convolution sum of currently and previously inputted data and a filter coefficient.

The entropy coder 1526 performs a statistical data compression using Golomb-Rice coding. In other words, the entropy coder 1526 allocates bits according to a dynamic range of the audio data using the Golomb-Rice coding. For example, a small bit is allocated to a relatively large data and a large bit is allocated to a relatively small data.

The compact encoder 152 may perform a low complex and real time operation.

The compact encoder 152 may be realized with hardware or software. If the compact encoder 152 is realized with software, a compact encoding operation of the compact encoder 152 is performed by the processor 110 of FIG. 1.

Figure 6:
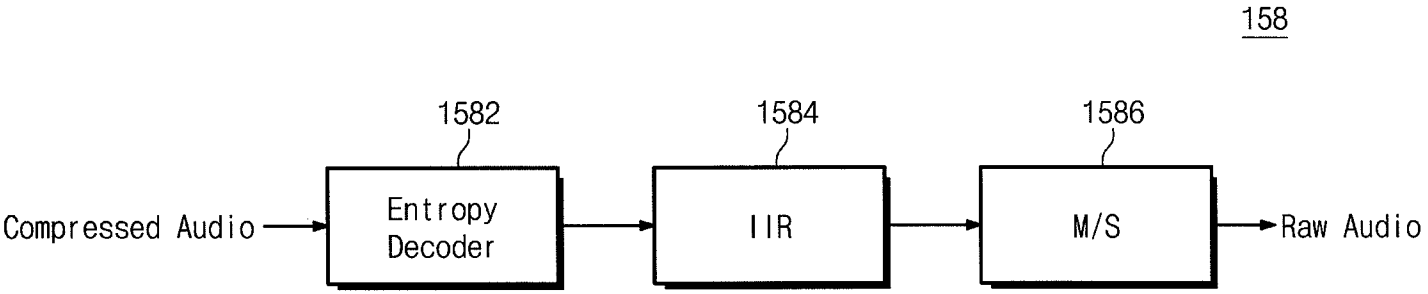
FIG. 6 is a block diagram illustrating a compact decoder according to an exemplary embodiment of the inventive concept.

FIG. 6 is a block diagram illustrating the compact decoder 158 according to an exemplary embodiment of the inventive concept. Referring to FIG. 6, the compact decoder 158 includes an entropy decoder 1582, an infinite impulse response pulse filter (or, IIR) 1584, and a mid-side decoder (or, M/S) 1586.

The entropy decoder 1582 performs a statistical data decompression using the Golomb-Rice coding. The entropy decoder 1582 performs an inverse function of the entropy coder 1526 shown in FIG. 5.

The infinite impulse response pulse filter 1584 is a linear filter performing a restoration function to restore information without loss, which is previously reduced by the finite impulse response filter 1524 shown in FIG. 5. The infinite impulse response pulse filter 1584 is a digital filter through which current output data include a convolution sum of currently and previously inputted data, a filter coefficient, and previous output data.

The mid-side decoder 1586 restores the information removed by the mid-side coder 1522 of FIG. 5, using the mid-side coding.

The compact decoder 158 may perform a low complex and real time operation through time domain coding.

The compact decoder 158 may be realized with hardware and software. If the compact decoder 158 is realized with software, a compact decoding operation of the compact decoder 158 is performed by the processor 110 of FIG. 1.

As mentioned with reference to FIGS. 5 and 6, the compact encoder 152 and the compact decoder 158 (hereinafter, referred to as a compact coder) may have low complexity and perform operations in real time. The compact coder has the following features compared to a conventional audio coder. Firstly, the compact coder according to an exemplary embodiment of the inventive concept does not have additional information about a frame unit of the audio data. Secondly, the compact coder according to an exemplary embodiment of the inventive concept supports a variable bit-rate, such that it does not use bit rate prediction or an iterative loop compared to a fixed compression rate method.

Accordingly, the compact coder according to an exemplary embodiment of the inventive concept may reduce a size of an audio output buffer by storing the compressed audio data during audio decoding. In a conventional audio decoding system, an output buffer occupies a relatively large space compared to an input buffer during audio decoding. This means that an output buffer may require a buffer space of more than ten times that of an input buffer if a compression rate of a main audio coder such as MP3 is very large, e.g., more than 1:10.

Additionally, in regard to the compact coder according to an exemplary embodiment of the inventive concept, the amount of output buffer space reduced (or saved) due to the storing of the compressed audio data during audio decoding may be used for an input buffer. Thus, power consumption of an audio decoding system including a compact coder can be reduced. This is so, because a sleep mode delay effect of a processor is obtained according to the input buffer's use of the spaced not needed for the output buffer. As a result, power consumption can be reduced.

In FIGS. 1 through 6, the processor 110 performs main decoding during audio decoding. However, the processor 110 of an exemplary embodiment of the inventive concept may not necessarily perform main decoding. The processor 110 may include an additional audio decoding block for performing main decoding. This audio decoding block may be a kind of IP (or, a subsystem).

Figure 7:
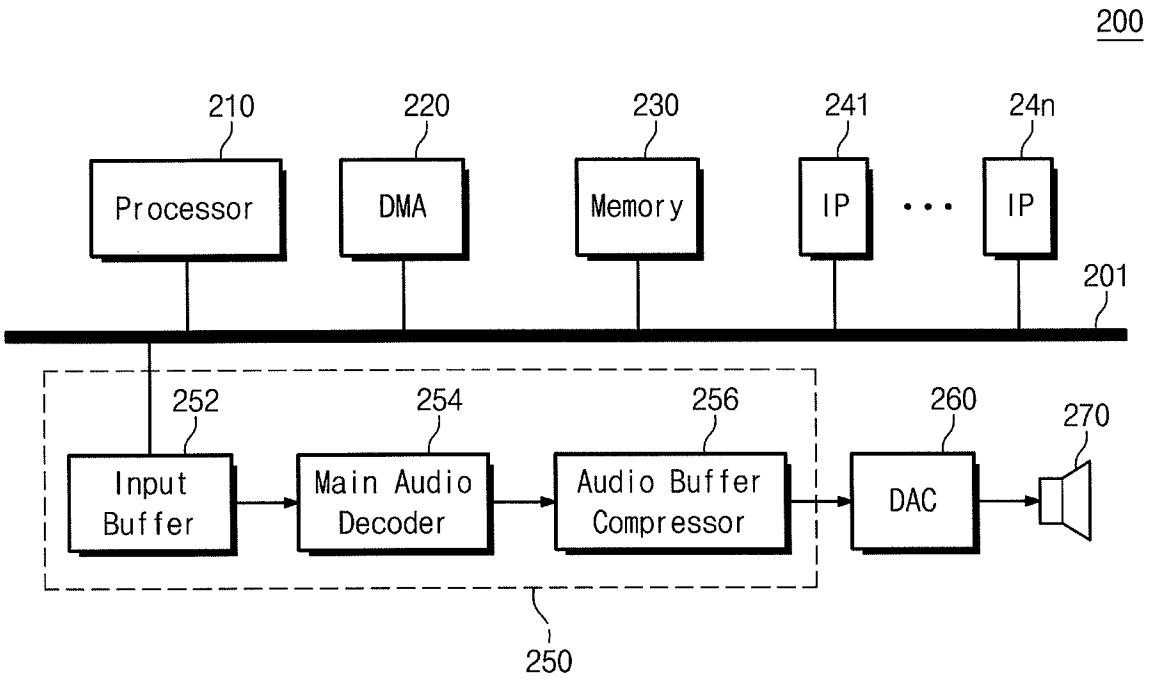
FIG. 7 is a block diagram illustrating an audio decoding system according to an exemplary embodiment of the inventive concept.

FIG. 7 is a block diagram illustrating an audio decoding system according to an exemplary embodiment of the inventive concept. Referring to FIG. 7, the audio decoding system 200 includes a processor 210, a DMA 220, a memory 230, a plurality of IPs 241 to 24*n*, an audio subsystem 250, a DAC 260, and a speaker 270. The processor 210, the DMA 220, the memory 230, the plurality of IPs 241 to 24*n*, and the audio subsystem 250 are connected through a bus 201.

The processor 210 controls general operations of the audio decoding system 200.

The DMA 220 may perform a function so that at least one of the plurality of IPs 241 to 24*n* directly accesses the memory 230. For example, audio data outputted from at least one among the plurality of IPs 241 to 24*n* is directly delivered to the memory 230 by the DMA 220, without passing through the processor 210.

The memory 230 temporarily stores data necessary for performing an operation of the processor 210 or the audio data.

The plurality of IPs 241 to 24*n* are devices for performing specific functions.

The audio subsystem 250 decodes audio data stored in the memory 230 and delivers the decoded audio data to the DAC 260.

The audio subsystem 250 includes an input buffer 252, a main audio decoder 254, and an audio buffer compressor 256.

The input buffer 252 receives audio data from the memory 230 by a frame unit. Although not illustrated in the drawings, the input buffer 252 may include a first input buffer for storing a first frame and a second input buffer for storing a second fame that follows the first frame. In other words, a frame may be alternately stored in the first input buffer and the second input buffer.

The main audio decoder 254 decodes the audio data of a frame unit stored in the input buffer 252.

The audio buffer compressor 256 receives audio data by a frame unit, which are decoded by the main audio decoder 254 and a compact encoder compresses the received audio data. An output buffer of the audio buffer compressor 256 stores the compressed audio data and a compact decoder of the audio buffer compressor 256 decompresses the audio data stored in the output buffer and outputs the decompressed audio data by a frame unit. Here, the compact encoder and the compact decoder mutually perform an inverse function. Although not illustrated here, the audio buffer compressor 256 may further include an interface for outputting the decompressed audio data.

The audio buffer compressor 256 may have the same configuration and may perform the same function as the audio buffer compressor 150 shown in FIG. 3.

The DAC 260 converts the audio data outputted from the audio buffer compressor 256 into an analog signal.

The speaker 270 outputs the analog signal converted by the DAC 260 to the outside.

Additionally, output buffers of the input buffer 252 and the audio buffer compressor 256 may be realized with one buffer memory. In other words, the buffer memory includes a region for an input buffer and a region for an output buffer.

The audio decoding system 200 may increase an allocation region of an input buffer in a buffer memory by having an output buffer for compressing and storing the decoded audio data. In other words, the audio decoding system 200 may include the input buffer 252 for storing a large frame compared to that of a conventional audio decoding system having a buffer memory of the same size. Thereby, the processor 210 of the audio decoding system 200 may obtain a longer sleep mode time compared to a processor of a conventional audio decoding system. As a result, the audio decoding system 200 may consume less power than a conventional audio decoding system.

Figure 8:
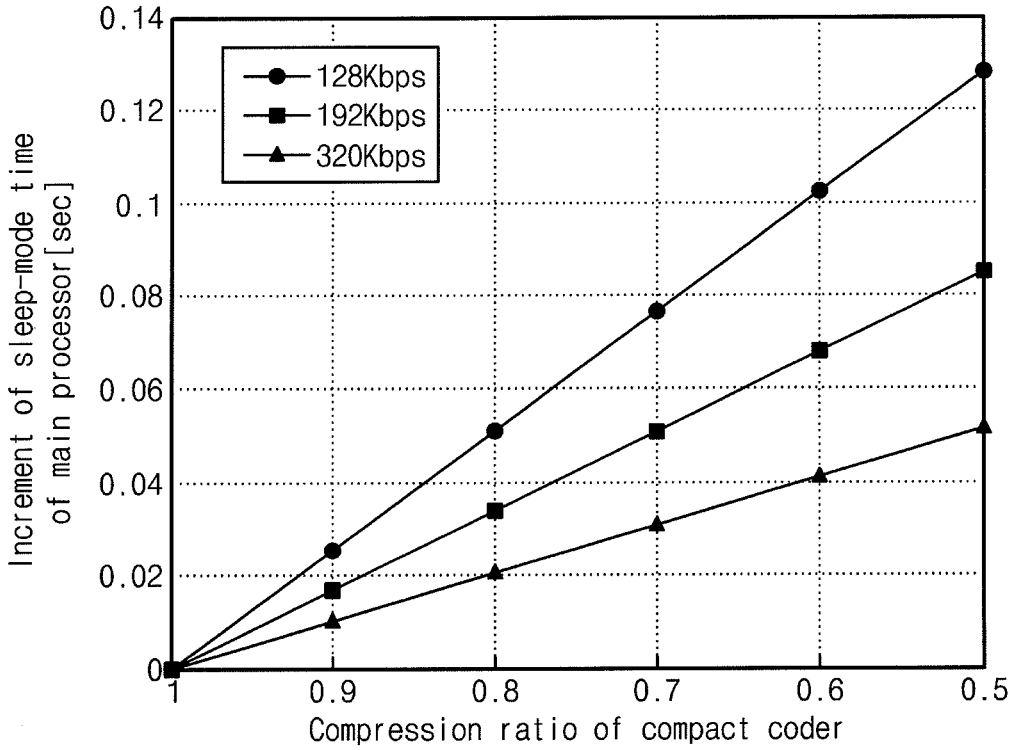
FIG. 8 is a view illustrating a compression ratio of a compact coder and a sleep mode time increase of a processor, according to an exemplary embodiment of the inventive concept.

The compact coder may have different compression rates according to input data. This may affect a reduction effect of an output buffer and increase a capacity of an input buffer. FIG. 8 is a view illustrating a compression ratio of a compact coder and a sleep mode time increase of a processor, according to an exemplary embodiment of the inventive concept. Referring to FIG. 8, as the compression ratio of a compact coder is high, the sleep mode time is increased. Thereby, as the compression ratio of a main audio coder is increased (or, a bit rate is low), a size of an audio frame stored in an input buffer is increased, such that the sleep mode delay effect and power consumption reduction effect of a processor can be achieved.

Figure 9:
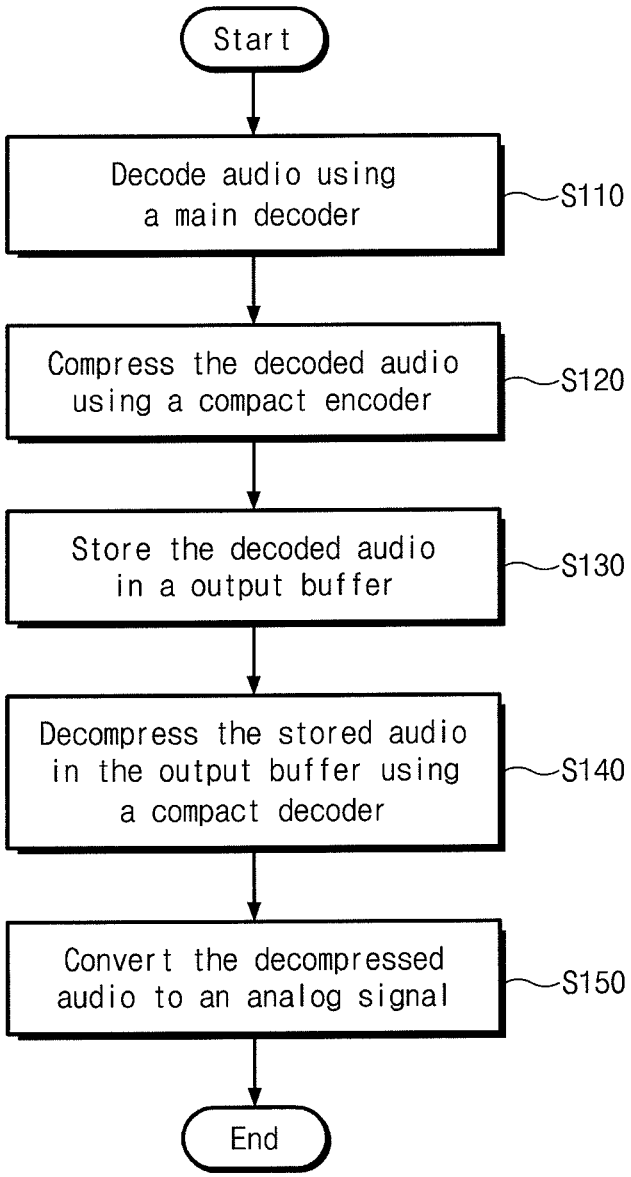
FIG. 9 is a flowchart illustrating an audio decoding method according to an exemplary embodiment of the inventive concept.

FIG. 9 is a flowchart illustrating an audio decoding method according to an exemplary embodiment of the inventive concept. Referring to FIG. 9, the audio decoding method is as follows.

In operation S110, a main decoder decodes audio data. Here, the main decoder is the processor 110 of the audio decoding system 100 of FIG. 1 or the main audio decoder 254 of the audio decoding system 200 of FIG. 7. For convenience of description, reference is hereinafter made to the audio decoding system 100 of FIG. 1.

In operation S120, the compact encoder 152 compresses the audio data decoded by the main decoder. Here, the compression operation of the audio data is performed right after the decoding of the N frame is completed as shown in FIG. 4.

In operation S130, the compressed audio data are stored in the output buffer. Here, the compressed audio data are sequentially stored in the first output buffer 154 and the second output buffer 156 as shown in FIG. 3.

In operation S140, the compact decoder 158 decodes the compressed audio data stored in the output buffer. For example, a decompression operation on the N−1 frame is performed at the same time when a decoding operation on the N frame is performed as shown in FIG. 4.

In operation S 150, the DAC 160 converts the decompressed audio data into an analog signal. The audio signal converted into the analog signal is outputted through the speaker 170 in real time, as shown in FIG. 4. In other words, the decompression operation on the N−1 frame is performed at the same time when the N−1 frame is played.

Audio decoding systems, e.g., MP3 and/or AAC players, according to exemplary embodiments of the inventive concept use an encoder and a decoder, which perform operations in real time, before and after buffering is performed by an output buffer, such that a size of an output buffer can be reduced. Through this, a memory design resource of a system on chip (SoC) can be saved.

Moreover, since output audio information of a long time is stored in a finite output buffer space, a cycle in which a mobile processor fills an audio buffer is increased. Thereby, an exemplary embodiment of the inventive concept can reduce power consumption during audio decoding.

In an audio decoding system and an audio decoding method thereof according to exemplary embodiments of the inventive concept, a size of an output buffer can be reduced by using a real time processing compact coder before and after an output buffer operation.

Moreover, in an audio decoding system and an audio decoding method thereof according to exemplary embodiments of the inventive concept, audio data can be stored in a limited output buffer for a long time such that an operation cycle of a processor for decoding is increased. Furthermore, a sleep mode time of a processor is increased and an additional operation for mode switching is eliminated, thereby reducing the number of processor mode switchings, such that power consumption is reduced.

While the inventive concept has been particularly shown and described with reference to exemplary embodiments thereof, it will be apparent to those of ordinary skill in the art that various changes in form and detail may be made therein without departing from the spirit and scope of the inventive concept as defined by the following claims.

What is claimed is:

1. An audio decoding system, comprising:

a first decoder decoding a first part of audio data; and an audio buffer compressor compressing and storing the decoded first part of audio data in a. first time interval and decompressing the stored first part of audio data in a second time interval, wherein the audio buffer compressor comprises:

a first encoder compressing the decoded first part of audio data in the first time interval and compressing, a decoded second part of audio data in the second time interval;

a first output buffer storing the compressed first part of audio data;

second output buffer storing the compressed second part of audio data; and a second decoder decompressing, in the second time interval, the compressed first part of audio data stored in the first output buffer, and decompressing, in a third time interval after the second time interval, the compressed second part of audio data stored in the second output buffer.

2. The audio decoding system. of claim 1, further comprising:

at least one information provider (IP) storing the first part of audio data prior to the decoding of the first part of audio data; and a memory storing the first part of audio data delivered from the at least one IP prior to the decoding of the first part of audio data,

3. The audio decoding system of claim 2, further comprising a direct memory access (DMA) allowing the first part of audio data to be delivered directly from the at least one IP to the memory.

4. The audio decoding system of claim 1, wherein the first decoder is a processor, the processor is in an active mode, in the first time interval, when the first part of audio data is decoded, and the processor is in a sleep mode, in the first time interval, after the decoded first part of audio data is compressed.

5. The audio decoding system of claim 1, wherein the first encoder comprises:

a mid-side coder removing spatial redundancy from each of the first and second parts of audio data using mid-side coding when the first and second parts of audio data are stereo audio data;

a finite impulse response filter selectively removing frequency region redundancy from an output of the mid-side coder; and an entropy coder compressing statistical data from an output of the finite impulse response filter using Golomb-Rice coding,

6. The audio decoding system of claim 5, wherein the second decoder comprises:

an entropy decoder performing an inverse function of the entropy coder by decoding the compressed first part of audio data stored in the first output buffer or the compressed second part of audio data stored in second output buffer using the Golomb-Rice coding;

an infinite impulse response filter restoring the removed frequency region redundancy by performing an inverse function of the finite impulse response filter; and a mid-side decoder restoring the removed spatial redundancy by performing an inverse function of the mid-side coder.

7. The audio decoding system of claim 1, further comprising a processor separate from the first decoder.

8. The audio decoding system of claim 1, wherein the audio buffer compressor decompresses another part of audio data in the first time interval, the another part of audio data having been decoded by the first decoder and compressed and stored by the audio buffer compressor prior to the first time interval.

9. An audio decoding system, comprising:

a plurality of information providers (IPs), at least one of the IPs storing audio data;

a memory storing the audio data delivered from the at least one of the plurality of IPs;

a direct memory access (DMA) allowing the plurality of if's to directly access the memory;

a processor performing a decoding operation on the audio data an audio buffer compressor compressing and storing the decoded audio data in a first time interval and decompressing and outputting the stored audio data in a second time interval;

a digital-to-analog converter (DAC) converting the audio data output from the audio buffer compressor into an analog signal in the time second interval; and a speaker outputting the converted analog signal to the outside of the audio decoding system in the second time interval, wherein the audio buffer compressor comprises:

a first encoder compressing a decoded first part of audio data in the first time interval and compressing a decoded second part of audio data in the second time interval;

a first output buffer storing the compressed first part of audio data;

second output buffer storing the compressed second part of audio data; and a second decoder decompressing, in the second time interval, the compressed first part of audio data stored in the first output buffer, and decompressing, in a third time interval after the second time interval, the compressed second part of audio data stored in the second output buffer.

10. The audio decoding system of claim 9, wherein the processor decodes the first part of audio data in the first time interval and is in a sleep mode in the first time interval after the decoding of the first part of audio data is completed, and the processor decodes the second part of audio data in the second time interval and is in the sleep mode in the second time interval after the decoding of the second part of audio data is completed.

11. The audio decoding system of claim 9, Wherein the speaker outputs a converted analog signal to the outside of the audio decoding system in the first time interval, wherein this converted analog signal corresponds to a part of the audio data that is decompressed by and output from the audio buffer compressor in the first time interval.

12. An audio decoding system, comprising:

a plurality of information providers (IPs), at least one of the IPs storing audio data;

a memory storing the audio data delivered from the at least one of the plurality of IPs;

a direct memory access (DMA) allowing the plurality of IPs to directly access the memory;

a processor controlling operations of the audio decoding system;

an audio subsystem decoding a first frame of the audio data received from the memory, compressing the decoded first frame of audio data in a first time interval, and outputting the compressed first frame of audio data in a second time interval;

a digital-to-analog convertor (DAC) converting an output of the audio subsystem into an analog signal; and a speaker outputting the converted analog signal to the outside of the audio decoding system in the second time interval, wherein the audio subsystem comprises;

a first encoder compressing the decoded first frame of audio data in the first time interval and compressing a decoded second frame of the audio data in the second time interval;

a first output buffer storing the compressed first frame of audio data;

a second output buffer storing the compressed second frame of audio data; and a second decoder decompressing in the second time interval, the compressed first frame of audio data stored in the first output buffer and decompressing, in a third time interval after the second time interval, the compressed second frame of audio data stored in the second output buffer.

13. The audio decoding system of claim 12, Wherein the audio subsystem comprises:

an input buffer receiving the first frame of audio data from the memory; and a main audio decoder decoding the first frame of audio data received by the input buffer.

14. The audio decoding system of claim 13, wherein:

the input buffer and the first and second output buffers are included in one buffer memory; and the buffer memory allocates regions of the buffer memory to the input buffer and the first and second output buffers.

15. An audio decoding method, comprising:

in a first time interval, decoding an $N^{th}$ (N is a natural number) frame of audio data in a processor or an audio decoder, compressing the decoded $N^{th}$ frame of audio data in an audio buffer compressor, and decompressing a compressed $N-1^{th}$ frame of audio data in the audio buffer compressor; and in a second time interval, decoding an $N+1^{th}$ frame of audio data in the processor or audio decoder, compressing the decoded $N+1^{th}$ frame of audio data in the audio buffer compressor, and decompressing the compressed $N^{th}$ frame of audio data in the audio buffer compressor, wherein the audio buffer compressor comprises:

first encoder compressing the decoded $N^{th}$ frame of audio data in the first time interval and compressing the decoded $N+1^{th}$ frame of audio data in the second time interval;

a first output buffer storing the compressed $N^{th}$ frame of audio data;

a second output buffer storing the compressed $N+1^{th}$ frame of audio data; and a second decoder decompressing, in the second time interval, the compressed $N^{th}$ frame of audio data stored in the first output buffer, and decompressing, in a third time interval after the second time interval, the compressed $N+1^{th}$ frame of audio data stored in the second output buffer.

16. The audio decoding method of claim 15, further comprising, in the first time interval, converting the decompressed $N-1^{th}$ frame of audio data into an analog signal in a digital-to-analog (DAC) converter and outputting, from a speaker, the analog signal of the converted $N-1^{th}$ frame of audio data to the outside of the speaker.

17. The audio decoding method of claim 16, further comprising, in the second time interval, converting the decompressed $N^{th}$ frame of audio data into an analog signal in the DAC and outputting, from the speaker, the analog signal of the converted $N^{th}$ frame of audio data to the outside of the speaker.

18. An audio decoding system, comprising:

a decoder decoding a first frame of audio data in a first time interval;

an audio buffer compressor compressing the first frame of audio data in the first time interval after the first frame of audio data is decoded, decompressing a second frame of audio data in the first time interval, the second frame of audio data corresponding to audio data decoded by the decoder and compressed by the audio buffer compressor prior to the first time interval, wherein the second frame of audio data is decompressed simultaneously to the decoding of the first frame of audio data and the compressing of the first frame of audio data; and a speaker outputting, to the outside of the audio decoding system, sound corresponding to the decompressed second frame of audio data simultaneously to the decompressing of the second frame of audio data in the first time interval, wherein the audio buffer compressor comprises:

a first encoder compressing the decoded first frame of audio data in the first time interval and compressing a decoded third frame of audio data in a second time interval after the first tine interval;

first output buffer storing the compressed first frame of audio data;

a second output buffer storing the compressed third frame of audio data; and a second decoder decompessing, in the second time interval, the compressed first frame of audio data stored in the first output buffer, and decompressing, in a third time interval after the second time interval, the compressed third frame of audio data stored in the second buffer.

* * * * *